US007094016B1

(12) United States Patent
Zaher

(10) Patent No.: US 7,094,016 B1
(45) Date of Patent: Aug. 22, 2006

(54) MULTI-PHASE FLOW PUMPING MEANS AND RELATED METHODS

(75) Inventor: Mouafak Arif Zaher, Auckland (NZ)

(73) Assignee: Unitec Institute of Technology, Mt. Albert (NZ)

( * ) Notice: Subject to any disclaimer, the term of this patent is extended or adjusted under 35 U.S.C. 154(b) by 0 days.

(21) Appl. No.: 10/030,109

(22) PCT Filed: Jul. 21, 2000

(86) PCT No.: PCT/NZ00/00134

§ 371 (c)(1),
(2), (4) Date: Mar. 20, 2002

(87) PCT Pub. No.: WO01/06128

PCT Pub. Date: Jan. 25, 2001

(30) Foreign Application Priority Data

Jul. 21, 1999 (NZ) ..... 336855

(51) Int. Cl.
*F04D 27/00* (2006.01)
*F04D 31/00* (2006.01)

(52) U.S. Cl. ..... 415/1; 415/58.4; 415/116

(58) Field of Classification Search ..... 415/1, 415/52.1, 56.1, 56.5, 58.4, 116, 11, 183, 182.1, 415/202, 57.2, 57.4, 58.6; 239/7, 86, 380, 239/381, 382, 408, 463, 472
See application file for complete search history.

(56) References Cited

U.S. PATENT DOCUMENTS

| | | | | |
|---|---|---|---|---|
| 1,382,665 | A * | 6/1921 | Myers | 415/56.5 |
| 3,238,534 | A * | 3/1966 | Derek | 415/116 |
| 3,286,639 | A * | 11/1966 | Hutton | 415/58.4 |
| 3,381,618 | A * | 5/1968 | Napolitano | 415/11 |
| RE26,570 | E * | 4/1969 | Dunn et al. | 415/58.4 |
| 3,588,266 | A * | 6/1971 | Scott-Scott et al. | 415/58.4 |
| 3,901,620 | A * | 8/1975 | Boyce | 415/58.4 |
| 4,027,993 | A * | 6/1977 | Wolff | 415/1 |
| 4,548,545 | A | 10/1985 | Lewis et al. | 415/90 |
| 4,834,887 | A | 5/1989 | Broughton | 210/512 |
| 4,964,783 | A * | 10/1990 | Haverkamp | 415/52.1 |
| 5,106,269 | A | 4/1992 | Castel | 417/63 |
| 5,375,976 | A | 12/1994 | Arnaudeau | 415/199 |
| 5,385,443 | A * | 1/1995 | Dufour | 415/116 |
| 5,580,214 | A | 12/1996 | Mohn | 415/64 |

(Continued)

FOREIGN PATENT DOCUMENTS

CH 680463 A5 8/1992

(Continued)

OTHER PUBLICATIONS

Furukawa, Memoirs of the Faculty of Engineering Kyushu Univ., vol. 48, No. 4, Dec. 1988, pp. 231-240, Fundamental studies . . .

(Continued)

*Primary Examiner*—Edward K. Look
*Assistant Examiner*—Richard A. Edgar
(74) *Attorney, Agent, or Firm*—Jacobson Holman PLLC

(57) ABSTRACT

A method of pumping and related arrangement for multi-phase fluid flow wherein a centrifugal pump is used for the suction and delivery of the multi-phase fluid which has a fluid communication providing portion to provide a communication of fluid bled from the outlet at a higher pressure to be injected into the inlet conduit of the centrifugal pump in operation. The centrifugal pump is provided with an impeller which has a plurality of vanes configured to define there between larger passageways when compared to a conventional centrifugal pump which would operate in or near optimum conditions when pumping liquid only.

16 Claims, 10 Drawing Sheets

U.S. PATENT DOCUMENTS

| | | | | |
|---|---|---|---|---|
| 5,605,444 | A | 2/1997 | Paton et al. | 416/183 |
| 5,609,468 | A * | 3/1997 | Burgess | 415/171.1 |
| 5,755,554 | A | 5/1998 | Ryall | 415/199 |
| 6,007,306 | A | 12/1999 | Vilagines | 417/307 |

FOREIGN PATENT DOCUMENTS

| | | | |
|---|---|---|---|
| EP | 0702156 | A1 | 3/1996 |
| EP | 0760427 | A1 | 3/1997 |
| GB | 2058218 | A | 4/1981 |
| GB | 2168764 | A | 6/1986 |
| GB | 2193533 | A | 2/1988 |
| GB | 2287288 | A | 9/1995 |
| RU | 2096665 | C1 | 11/1997 |
| WO | WO99/46513 | | 9/1999 |

OTHER PUBLICATIONS

Furukawa, 69th JSME Fall Annual Meeting, vol. B, No. 1118, 1991, On an improvement in air/water two phase flow performance of . . .

* cited by examiner

| | 100% Water | | | | 3 Vane Impeller: Air/Water Mixture - Intake air pressure 30psig | | | | | | | | | | | | | | | | | | | |
|---|---|---|---|---|---|---|---|---|---|---|---|---|---|---|---|---|---|---|---|---|---|---|---|---|
| | | | | | 10% | | | | 20% | | | | 30% | | | | 40% | | | | 50% | | | |
| Q(L/s) | 1 | 0.9 | 0.84 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 |
| H(m) | 1.9 | 2.3 | 2.5 | 3.6 | 2.3 | 2.6 | 2.9 | 3.1 | 2.2 | 2.5 | 2.8 | 3.2 | 2.1 | 2.5 | 2.6 | 3.1 | 2 | 2.4 | 2.7 | 3.1 | 1.8 | 2.5 | 2.6 | 3 |
| $\eta_0$ (%) | 75 | 82 | 83 | 0 | 76 | 43 | 24 | 0 | 72 | 40 | 23 | 0 | 69 | 40 | 23 | 0 | 65 | 39 | 22 | 0 | 59 | 40 | 22 | 0 |
| Bhp (kW) | 0.18 | 0.2 | 0.2 | 0 | 0.18 | 0.1 | 0.06 | 0 | 0.18 | 0.1 | 0.06 | 0 | 0.17 | 0.1 | 0.06 | 0 | 0.16 | 0.1 | 0.05 | 0 | 0.14 | 0.1 | 0.05 | 0 |

| | 3 Vane Impeller: Air/Water Mixture - Intake air pressure 30psig | | | | | | | | | | | | | | | | | | | |
|---|---|---|---|---|---|---|---|---|---|---|---|---|---|---|---|---|---|---|---|---|
| | 60% | | | | 70% | | | | 80% | | | | 90% | | | | 100% | | | |
| Q(L/s) | 0.83 | 0.41 | 0.21 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 |
| H(m) | 2 | 2.4 | 2.7 | 3 | 1.9 | 2.3 | 2.5 | 2.9 | 1.9 | 2.3 | 2.5 | 2.7 | 1.85 | 2.3 | 2.4 | 2.7 | 1.9 | 2.3 | 2.4 | 2.8 |
| $\eta_0$ (%) | 66 | 39 | 22 | 0 | 62 | 37 | 21 | 0 | 62 | 37 | 21 | 0 | 61 | 37 | 20 | 0 | 62 | 37 | 20 | 0 |
| Bhp (kW) | 0.15 | 0.09 | 0.05 | 0 | 0.15 | 0.09 | 0.05 | 0 | 0.15 | 0.09 | 0.05 | 0 | 0.15 | 0.09 | 0.05 | 0 | 0.15 | 0.09 | 0.05 | 0 |

FIGURE 10

| | 100% Water | | | | 4 Vane Impeller: Air/Water Mixture - Intake air pressure 30psig | | | | | | | | | | | | | | | | | | | |
|---|---|---|---|---|---|---|---|---|---|---|---|---|---|---|---|---|---|---|---|---|---|---|---|---|
| | | | | | 10% | | | | 20% | | | | 30% | | | | 40% | | | | 50% | | | |
| Q(L/s) | 1 | 0.98 | 0.92 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 |
| H(m) | 1.6 | 1.78 | 2.1 | 3.34 | 2.1 | 2.2 | 2.9 | 3 | 2.2 | 2.4 | 2.9 | 3.1 | 2.1 | 2.3 | 2.7 | 3 | 1.9 | 2.3 | 2.8 | 3.1 | 2.1 | 2.4 | 2.9 | 3.1 |
| $\eta_0$ (%) | 63 | 63 | 76 | 0 | 69 | 36 | 24 | 0 | 72 | 39 | 24 | 0 | 69 | 37 | 22 | 0 | 62 | 37 | 23 | 0 | 69 | 39 | 24 | 0 |
| Bhp (kW) | 0.15 | 0.15 | 0.18 | 0 | 1.7 | 0.09 | 0.06 | 0 | 0.18 | 0.09 | 0.06 | 0.17 | 0.17 | 0.09 | 0.05 | 0 | 0.15 | 0.09 | 0.06 | 0 | 0.17 | 0.09 | 0.06 | 0 |

| | 4 Vane Impeller: Air/Water Mixture - Intake air pressure 30psig | | | | | | | | | | | | | | | | | | | |
|---|---|---|---|---|---|---|---|---|---|---|---|---|---|---|---|---|---|---|---|---|
| | 60% | | | | 70% | | | | 80% | | | | 90% | | | | 100% | | | |
| Q(L/s) | 0.83 | 0.41 | 0.21 | 0 | 0.83 | 0.41 | 0.21 | 0 | 0.83 | 0.41 | 0.21 | 0 | 0.83 | 0.41 | 0.21 | 0 | 0.83 | 0.41 | 0.21 | 0 |
| H(m) | 2 | 2.3 | 2.7 | 3.2 | 1.9 | 2.3 | 2.7 | 2.9 | 1.95 | 2.3 | 2.8 | 3 | 1.9 | 2.4 | 2.7 | 3.2 | 1.9 | 2.5 | 3 | 3.1 |
| $\eta_0$ (%) | 65 | 37 | 22 | 0 | 62 | 37 | 22 | 0 | 64 | 37 | 23 | 0 | 62 | 39 | 22 | 0 | 62 | 40 | 25 | 0 |
| Bhp (kW) | 0.16 | 0.09 | 0.05 | 0 | 0.15 | 0.09 | 0.05 | 0 | 0.16 | 0.09 | 0.06 | 0 | 0.15 | 0.09 | 0.05 | 0 | 0.15 | 0.1 | 0.06 | 0 |

FIGURE 12

| $H_2\phi/H_R$ | 4-vane | 3-vane |
|---|---|---|
| 0.11 | 0.9 | 0.92 |
| 0.25 | 0.95 | 0.88 |
| 0.43 | 0.9 | 0.84 |
| 0.67 | 0.83 | 0.8 |
| 1 | 0.9 | 0.72 |
| 1.5 | 0.87 | 0.8 |
| 2.3 | 0.83 | 0.76 |
| 4 | 0.85 | 0.76 |
| 9 | 0.83 | 0.74 |
| 50 | 0.83 | 0.72 |

MULTI-PHASE FLOW PUMPING MEANS AND RELATED METHODS

This is a nationalization of PCT/NZ00/00134, filed Jul. 21, 2000 and published in English.

The present invention relates to improvements in or relating to multi-phase flow pumping means and related methods.

BACKGROUND ART

Two-phase fluid pumping covers a large spectrum of pump operation and applications. In certain situations the entrained gas within a liquid medium will cause unwanted problems in the pumping process. For the off-shore oil industry there is now considerable interest in pumping liquids with a high gas content, similar as there has been for some time in the pumping systems supplying aircraft gas turbines. This interest is also found within the geothermal industry. In many oil fields, the wells contain mixtures of gas and oil in varying proportions. The handling of such fluids can create problems. The problems are strictly multi-phase, which essentially means that as the gas or steam content increases the pressure head degrades multi-phase pumps which have relatively good performance characteristics are normally of screw type. While centrifugal pumps are known to be used in the pumping of multi-phase fluids they have had limited success. It is however desirable for centrifugal pumps to be utilised in the pumping of fluids as centrifugal pumps provide the benefit of both a reduced cost when compared to many other types of pumps, simplicity of operation and construction and hence reduced maintenance, and also are normally of a smaller size.

Two-phase pumping applications utilising a centrifugal pump are known in for example the pumping of sewage. Flow separation of the different fluids prior to pumping of the pump is a common way of dealing with delivery of multi-phase flow. This is for example illustrated in the specification of U.S. Pat. No. 5,580,214. The present conventional designs of centrifugal pumps are not adequate due to their inability to pump high gas volume fraction media. Work by A Furukawa: "*Fundamental studies on tandem blades impeller of gas liquid two phase centrifugal pump*" *Memoirs of the Faculty of Engineering Kyushu University,* 48, 4, 231–40 or "*On an improvement in air/water two phase flow performance of a centrifugal pump in the partial flow rate of water.*" *69th JSME Fall Annual Meeting, vol. B, paper number* 1118, pp. 165–7[1] suggests using tandem or slotted blades to reduce the degradation in a limited range, of liquid to gas content.

Two-phase flow includes both a compressible and substantially incompressible fluid and the coexistence of liquid and vapour phases. The composition of the fluid flow and variety of flow configurations where each phase has a different velocity in such cases makes the flow difficult to define. Particularly as the flow composition and configurations vary over time, and may reach gas volume percentages as high as 90 to 100 percent.

It is known that where free gas is present in a liquid being pumped the head, power and efficiency of rotodynamic pumps are known to decrease. (See FIG. 1). Although multi-phase products have been pumped for many years with double screw type pumps, centrifugal impeller pumps have shown serious departures from published performance curves. The head when surging begins, oscillates from high to low values once the percentage by volume of gas exceeds some point between 7% and 11% by volume of intake.

The mechanism that seems to control surge and chocking in a centrifugal pump which is pumping a multi-phase fluid is the separation of the gas phase from the liquid phase and a tendency to coalescence in a large gas pocket at the blade entry throat and the sonic chocking to the reduction of the speed of sound. The various pressure fluids which operate inside the impeller passages play a critical role in the two mechanisms mentioned above.

The decrease in efficiency of pumping multi-phase flow suggests that some additional loss mechanisms arise when gassy liquids are pumped. The decrease in head is greater than that which can be associated with the decrease in average density of the liquid-gas mixture. The pump performance decreases continuously as the gas volume increases until at a certain critical gas content the pump loses prime. The above trend is common to radial, mixed, and axial-flow type pumps either in single or in multistage configurations.

Basically the operating range appears to be limited by two phenomena:

1) gas locking or "choking", and 2) instability in the head-capacity curve which causes surge.

Also the property of two-phase flow media is the large influence of gas content on the speed of sound. Normal values of peak relative velocities around the blade leading edge are in this range. Therefore, pumps operate at transonic or supersonic local flow. It is not surprising that a blade design for incompressible single-phase flow is not very effective in multi-phase flow and produces choking for relatively high gas volume fraction. Theory shows that the dramatic variation of the speed of sound at low percentages is very much related to the large difference in density between the two phases. The sonic velocity in two-phase mixtures is also pressure dependent.

Accordingly it is an object of the present invention to reduce the abovementioned disadvantages and problems or to at least provide the public with a useful choice.

BRIEF DESCRIPTION OF THE INVENTION

Accordingly in a first aspect the present invention consists a pumping arrangement for pumping multi-phase fluid flow said arrangement comprising:

a centrifugal pump which includes a fluid inlet and an outlet and driveable by a power providing means (e.g. an electric motor), a fluid communication providing means to provide a communication of fluid between said outlet and said inlet of said pump, said fluid communication being such as to provide a fluid connection between said outlet and said inlet to deliver fluid of a higher pressure from said outlet to said inlet when said centrifugal pump is in operation, wherein said centrifugal pump is provided with an impeller which has a plurality of vanes configured to define there between larger passageways when compared to a conventional centrifugal pump which would operate in or near optimum conditions when pumping liquid only.

Preferably said arrangement is for pumping a fluid of a gaseous/liquid mix.

Preferably said power providing means is an electric motor.

Preferably said fluid connection is a bleed line to bleed a portion of said fluid from the outlet of said centrifugal pump to the inlet.

Preferably said fluid connection between said outlet and inlet of said centrifugal pump is provided with at least one nozzle at the inlet for injection of bled fluid into the delivery line of said inlet of said centrifugal pump.

Preferably said at least one nozzle provides, an increase in velocity head to said bled flow prior to the point of injection by reducing the flow area of the fluid connection means.

Preferably said at least one nozzle is oriented in respect of the delivery line of the inlet so as to impart a pre-rotation force onto the main inlet side fluid delivery.

Preferably said pre-rotation is in a direction co-rotatory with said impeller rotation direction.

Preferably said impeller is not of a substantially greater diameter than said conventional pump.

Preferably the impeller is one modified from a one of a centrifugal pump which would be ordinarily (to operate at or about peak efficiency) designated to pump in a similar situation to the pump of the present invention but where the fluid is liquid only, said modification including the removal of vanes to provide said larger passageways, but to a limit of no less than 2 vanes remaining present.

Preferably said impeller has between 2 and 4 vanes.

Preferably said impeller has 4 vanes.

In a second aspect the present invention consists in a method of pumping multi-phase fluid flow said arrangement comprising:

providing a centrifugal pump which includes a fluid inlet connected in fluid communication with a fluid source and an outlet though which said fluid is delivered, providing a power providing means to rotate the impeller of said centrifugal pump bleeding a portion of fluid from the outlet and delivering the bled fluid via a fluid connection providing means to said inlet to be injected into the main fluid flow into said centrifugal pump fluid, wherein said centrifugal pump is provided with an impeller which has a plurality of vanes configured to define there between larger passageways when compared to a conventional centrifugal pump which would operate in or near optimum conditions when pumping liquid only.

Preferably said method further includes providing a flow control means in said fluid connection providing means to allow the rate of bled fluid flow to be controlled.

Preferably said method further includes the provision of a means to measure the volumetric rate and head of pressure of delivered fluid, the measurements taken to be utilised in setting of the flow control means.

Preferably said bleeding includes prior to the injection of said fluid, the splitting of fluid into at least two separated flow paths, wherein for each flow path there is an injection nozzle provided to inject the flow into the main suction flow to said centrifugal pump.

Preferably said injection of said bled fluid is in a manner which induces a rotation onto the main suction flow of fluid.

Preferably said rotation is in a direction co-rotatory with the direction of rotation of the impeller.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

One preferred form of the present invention will now be described with reference to the accompanying drawings in which;

DESCRIPTION OF THE DRAWINGS

FIG. 10 is a table illustrating results from the series of trials that were performed using the equipment and procedures as hereinafter described, FIG. 12 is a similar table to that shown in FIG. 10, the results in this case being for a four vane impeller rather than a 3 vane impeller.

DETAILED DESCRIPTION OF THE INVENTION

Figure 1:
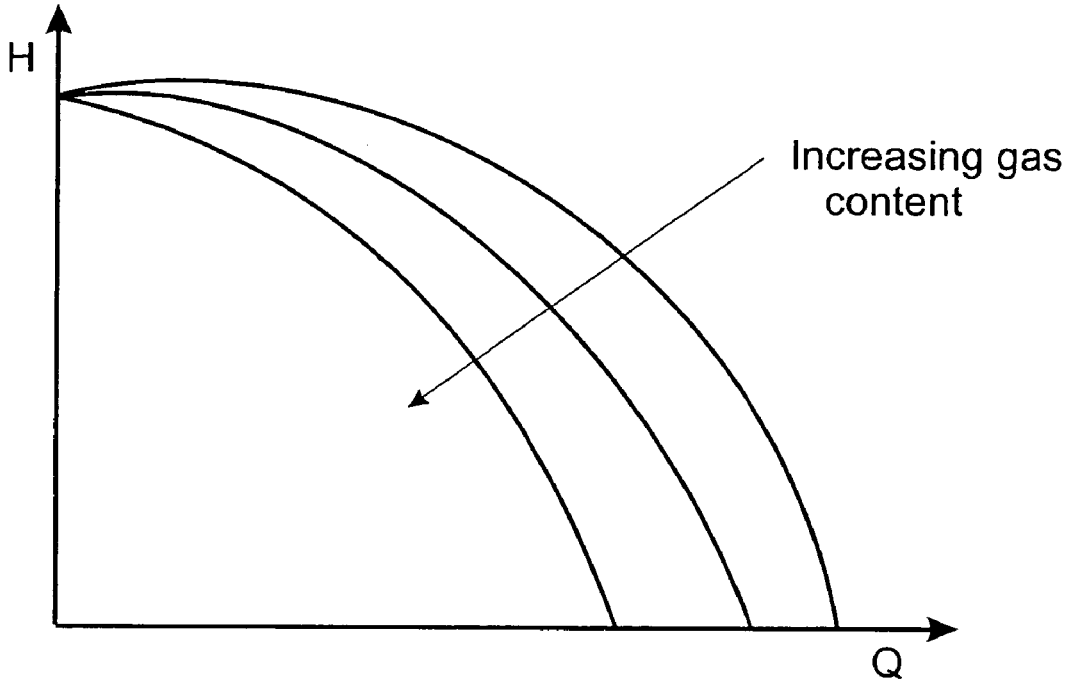
FIG. 1 is a graph illustrating, as is commonly known, that when the gas contents of a fluid being pumped increase, there is a reduction in the head (H) and flow rate (Q) characteristics.
Figure 2:
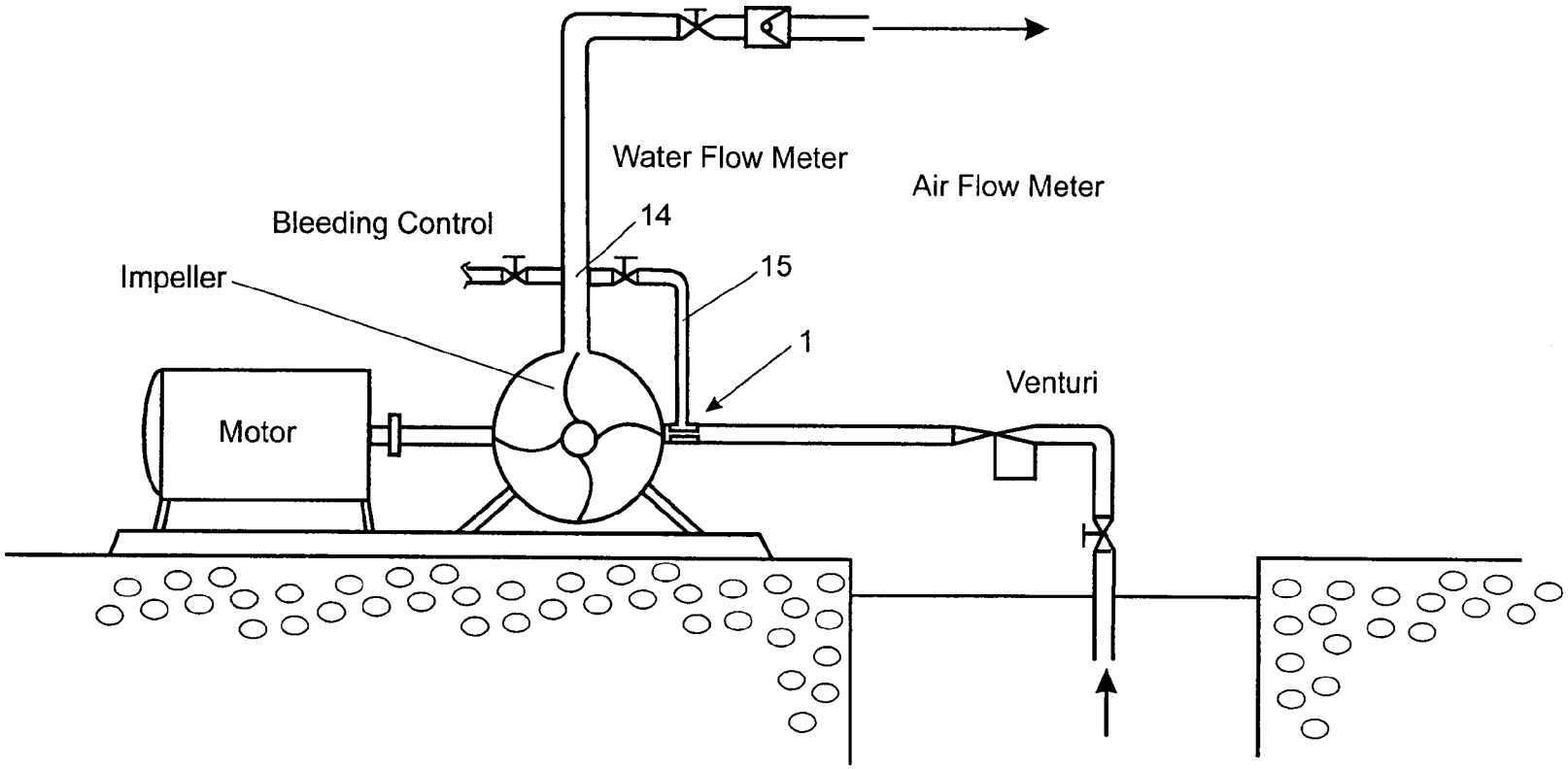
FIG. 2 is a schematic layout of an arrangement for pumping of multi-phase fluids utilising an injection.

The pumping system according to the present invention includes a centrifugal pump 1 which has a suction side 16 and a delivery side 17.

The conduit or conduits connected to the delivery side of the pump are provided with a means to split 14 and separate (e.g. to bleed) some of the delivered fluid wherein one of the portions of split fluid is redirected via a fluid communication means 15 such as a conduit to deliver the split fluid to the inlet side or suction side of the pump. Preferably the delivery of split fluid back to the suction side of the pump is achieved by a nozzle unit positioned slightly upstream from the opening of the volute casing of the pump. The nozzle unit has preferably 4 nozzles and preferably injects the bled flow with a tangential component of velocity into the delivery conduit. This bleeding arrangement may be similar to that as described in our PCT application PCT/NZ99/00029. It has been found that by the inclusion of the bleeding system as for example described in our international PCT application PCT/NZ99/00029, (the contents of which is hereby to be read to be included in full in this specification), that difficulties as hereinbefore detailed, with multi-phase flow pumping are alleviated.

A control valve may also be placed in the bleed system to control the rate of flow which is directed to the nozzle unit(s) on the suction conduit of the centrifugal pump. In overcoming the phenomena resultant from the gas content, it has been found in combination with the injected bled flow, that modification is required to the impeller of the standard centrifugal pumps. It is known that standard centrifugal pumps normally utilise approximately 7 or 8 impeller vanes for the pumping of liquids. It has been found that, to overcome the phenomena which normally cause the loss in head once the gas contents increases beyond a certain limit, an increase of volume of the passage ways between the vanes is required in order to avoid the formation of air pockets within the impeller passages.

With reference to the test results obtained from experimental tests which are hereinafter described, it has been found that a method of pumping multi-phase flow utilising a centrifugal pump has overcome or at least improved on the problems and limitations of the prior art.

In proving testing facilities for the present invention the suction pipe is modified to allow the introduction of air. A bleeding control system is placed on the discharge pipe with suitable nozzle unit(s) placed ahead of the pump impeller on the suction pipe. The pump is initially tested on water to establish a base performance level for comparison with the multi-phase performance. In this test, the pump is operated in the normal mode with water being drawn from the suction pit and discharged through a pressure control valve back to the pit. The capacity is measured at various discharge pressures to obtain the characteristic performance on water. A series of tests is then to be conducted with increasing amounts of air being drawn into the inlet pipe. The air flow rate is measured with a variable area flow meter adjusted to the pump inlet pressure.

With the arrangement of bleeding as broadly described in our PCT specification PCT/NZ99/00029 and that shown in the drawings of the present specification, and correct impeller design, a radical solution is offered to handle a multi-phase flow, for pumping multi-phase flow with gas/steam content variable over a large range between zero percent to 100 percent in for example oil/geothermal production industry. During pumping of multi-phase fluids gas starts to accumulate at the start of the pump and this results in a pocketing of the fluid. It is much like when certain pumps require priming to remove any air from the system prior to the pump operating efficiently. It is suggested by the inventor that with larger passages in conjunction with upstream flow modification by injection of fluid into the intake conduit, has improved the efficiency and effectiveness of centrifugal pumps, to handle multi-phase fluids.

The present invention proposes to compensate the increase power requirement by removing vanes from a standard impeller of a standard centrifugal pump (standard in respect of it normally pumping at or near optimum, a fluid which is 100 percent liquid) the removal of such vanes increasing the passage way size. Such increase in passage way size does increase the mass which is being drawn through the impeller and the increase in power it is suggested is compensated at least in part by providing an upstream rotation (preferably co-rotating) of fluid by the injection of fluid into the intake conduit. Such rotation is not aimed at separating the phases of flow but merely to provide an increase in the energy (in large by the velocity head increase) of the intake flow in combination with improved flow directions.

The problem with existing attempts at pumping multi-phase flow also is with respect to sonic problems. Sonic boom type problems occur if the relative velocity of the flow and the vanes is such as to create (dependent on the state of the fluid) subsonic problems. It is suggested by the inventor that to ensure that the speed of sound is not exceeded by the vanes there is an induced flow provided to the intake fluid in such a manner to reduce this possibility. This is achieved by the injection as suggested which aids in providing a modification of the state of the intake fluid (i.e. pressure) to furthermore reduce such an occurrence of sonic boom. By way of example, reference is now made to experimental trails which support the improvements provided by the present invention.

EXAMPLE

The following is a description of details of experiments conducted on a centrifugal pump. The pump was tested in two modes, a first, normalising mode where the fluid being pumped was 100% water and a second mode at various degrees of air void fraction. This was repeated for two different impeller configurations, a first 4 blade impeller and a second 3 blade impeller.

The Setup

The centrifugal pump used was operating with low head of 2 meters. The specifications of the pump are as follows

| Item | |
|---|---|
| Pump size | 190 × 160 × 100 mm |
| Pump type | Vertical<br>Centrifugal<br>Single suction<br>Single discharge |
| Nozzle units | 4 × 12 mm $d_B$ |
| Number of blades | 3 and 4 |
| Impeller diameter | 50 mm |
| Inlet blade angle (degrees) | 79/72 degrees |
| Outlet blade angle (degrees) | 42/47 degrees |
| Rated head | 2 m (6.56 ft) |
| Rated flow | 0.8 l/s (12.7 gpm) |
| Specific speed (dimensionless) | 2,431 |
| Suction specific speed (dimensionless) | 6,874 |
| Motor power (kW) | 0.25 |
| Motor (rpm) | 2,800 |

Figure 3:
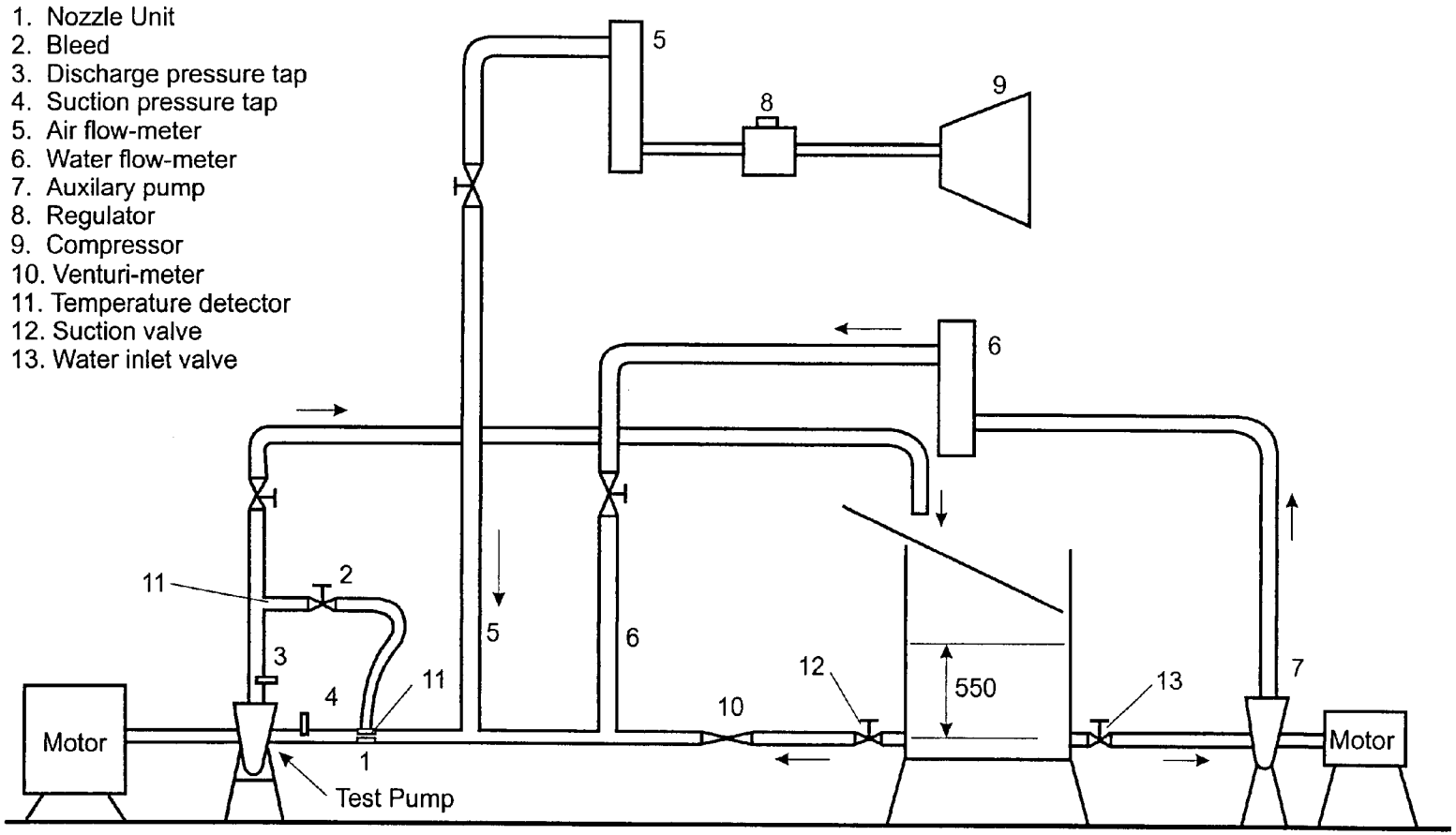
FIG. 3 is a test rig layout diagram for the test conducted on the centrifugal pump to determine standard performance at 100% water flow to determine valves of flow characteristics including HR, and for testing a multi-phase at various liquid/gas contents of the fluid being pumped.
Figure 9:
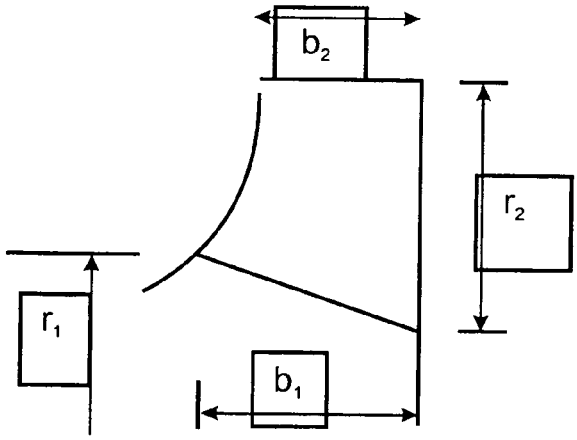

The test pump has modified centrifugal impellers (3 vanes and 4 vanes) and a single discharge volute. There is a conical diffuser at the higher-pressure end of the pump. The pump has the following dimensions with reference to FIG. 9. $r_1$=10 mm, $r_2$=25 mm $b_1$=12 mm, $b_2$=8 mm, FIG. 3 shows the two test circuits used. FIG. 3 shows the base performance testing which can be switched to the multi-phase flow testing circuit by closing the main line valve 12 and opening the water line valve 13 to redirect flow.

A venturi-meter for the base performance test is placed in the suction line (main line) to measure the volume of discharged water per unit time.

The water flow meter 6 (to measure volumetric flow rate) is connected to an auxiliary pump having similar characteristics as that of the tested pump. The air flow meter 5 (to measure volumetric flow rate) is connected to a regulator and a compressor having the following characteristics:

Working pressure=8 bars

Motor speed=2910/2860 rpm, 240 volts, 8.8 amperes, 50 Hz

Gauge manometers were used to measure the pressure head at the suction and delivery sides.

Tests were performed with a 3 blade and 4 blade impeller of which the details were as follows.

The blade inlet angles were as follows:

Three blade impeller=79 degrees

Four blade impeller=72 degrees and the vane lengths are:

Three blade impeller=15 mm

Four blade impeller=15 mm

Tests were was run at impeller speed of n=2800 rpm

The nominal flow rate was:

$$Q_n=0.8 \text{ L/S (discharge flow rate)}$$

and the corresponding head was:

$$H_n=2 \text{ m}$$

The pumps Reynolds number (Re) was found to be in the range of $Re=Vd/v=10^5$ at the inlet to the impeller.

Tests were conducted using the controlled bleeding arrangement, transferring a portion of the pressure energy in the discharge line, back to the suction side. A nozzle unit was placed near the impeller entrance.

The function of the nozzle unit is a supplier of pressure energy and imparts the particles of the fluid with tangential acceleration preferably in the direction of rotation of the impeller.

Figure 4:
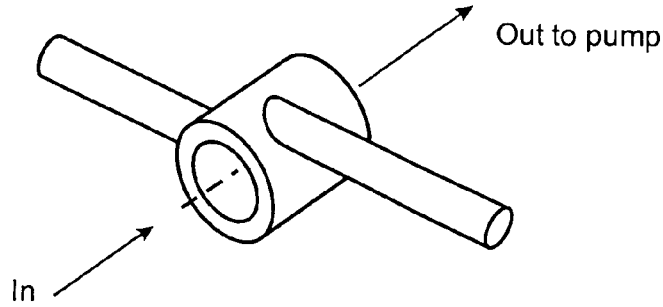
FIG. 4 is a perspective of a nozzle unit with two nozzle points.
Figure 5:
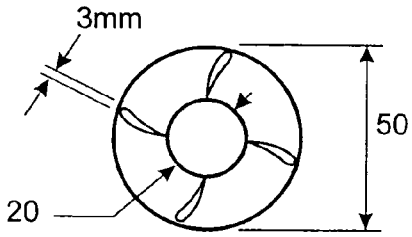
FIGS. 5 and 6 are diagrams of impellers used in the testing of a pump.
Figure 6:
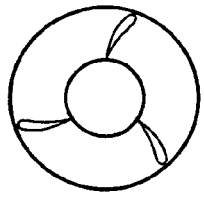
Figure 7:
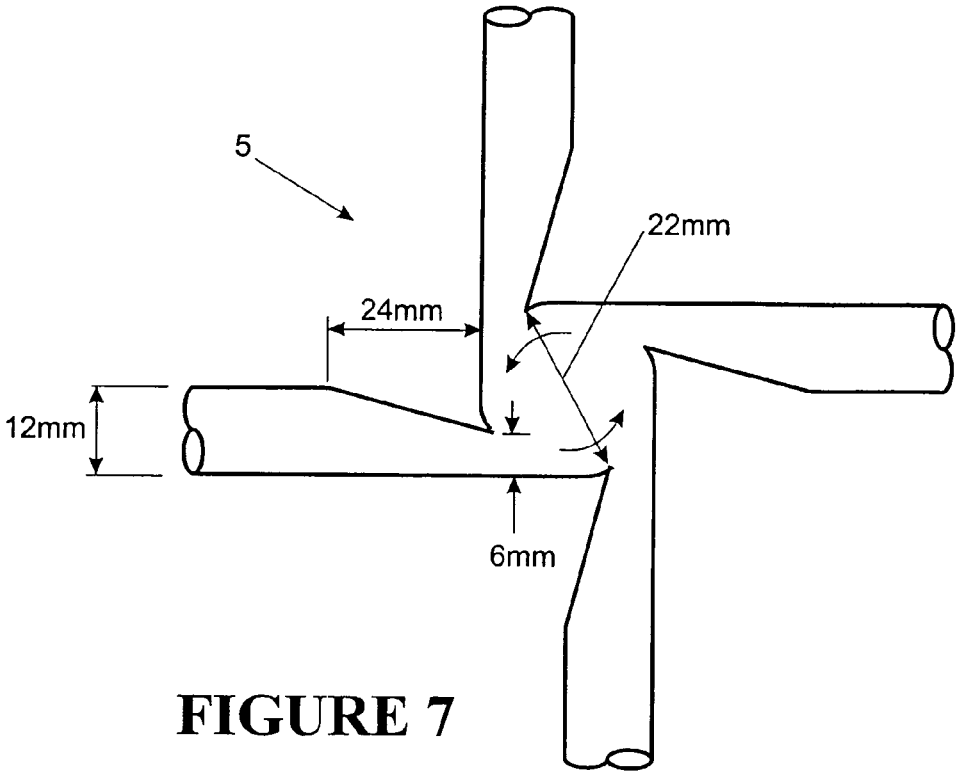
FIG. 7 is a sectional view through inlet conduit to the centrifugal pump at the position where the four injector nozzles are placed.
Figure 8:
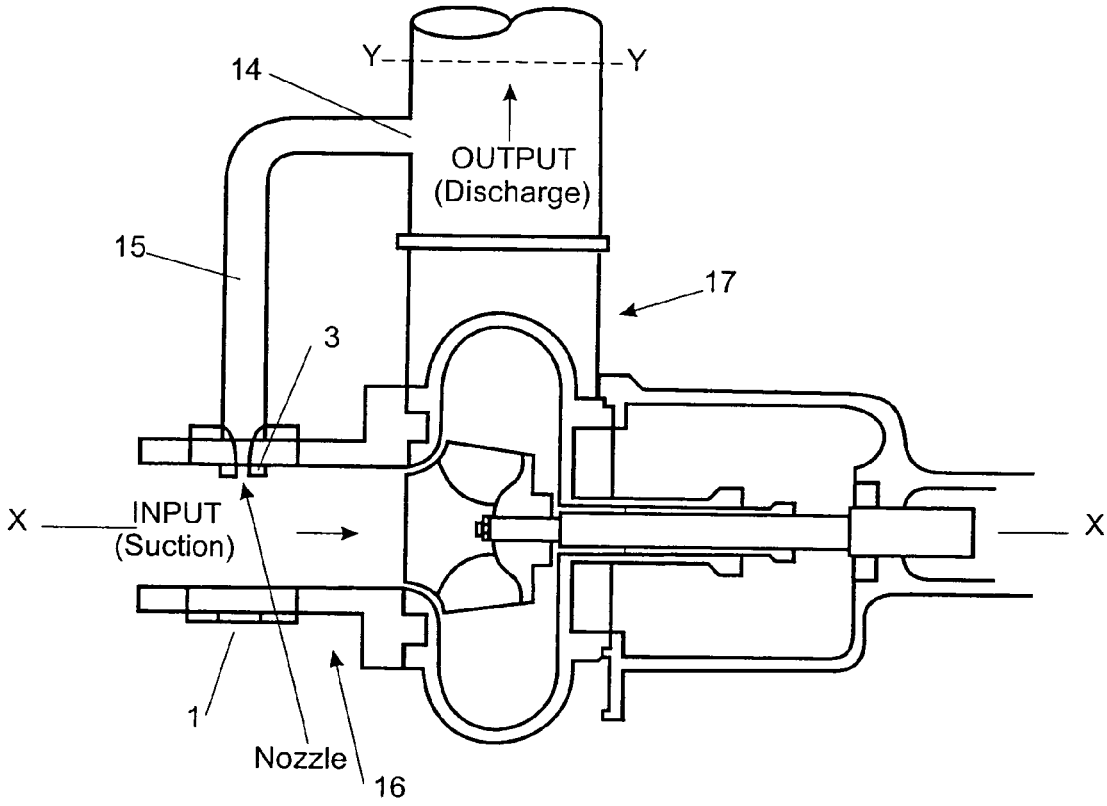
FIG. 8 is a sectional view through the pumping arrangement at the centrifugal pump including an illustration of the bleed system and injection nozzle, FIG. 9 illustrate the dimension of the pump with reference to the description.

The following table and FIG. 4 gives the geometric dimensions of the nozzle unit used

| Item | |
|---|---|
| Number of nozzles (Z) | 4 |
| Bleeding pipe diameter to nozzle ($d_B$) mm | 12 |
| Nozzle-head diameter ($d_N$) mm | 6 |
| Length of taper (L) mm | 24 |
| Distance from impeller entrance (mm) | 65 |

The test loops were fully instrumented to measure the flow conditions at the suction and discharge of the pump. It was also possible to monitor all the important parameters under two phase flow conditions. They included the flow rate (Q), pump head (H), motor power (BHP), void fraction ($\alpha_s$), as well as pressures and temperatures around the loops. The suction void fraction was measured using water/air flow-meters.

The suction piping was modified to allow the introduction of air into the pipe and also injection of amounts of water.

The Procedure

Tested were first conducted with 100% water to establish a base performance for comparison with the multi-phase performance. In the tests the pump was operated on levels of delivery head of 550 mm measured relative to the centre-line of the suction pipe.

The water drawn from the tank passes through a venturi-meter on the suction line, the tested pump, and finally discharges through a pressure control valve back to the tank via a separator. The capacity was measured at various discharge pressures to obtain the characteristic performance with water.

A series of tests was then conducted with increasing amount of air in the flow in accordance with the second test loop shown in FIG. 3.

The airflow rate was measured using an air flow meter and adjusted to the pump inlet pressure.

The two-phase pump head data, the water density $\rho_L$ and air density $\rho_g$ were computed at normal pump conditions. The two phase mixture density at the suction of the pump can be obtained from the following equation $$\rho_{2\phi}=\rho_g\alpha+(1-\alpha)\rho_L$$

The two-phase pump head is calculated as the ratio of the static pressure difference across the pump to the two-phase mixture density obtained from equation $$H_T=(P_2-P_1)/\rho_{2\phi}$$

Normalised pump head is defined as the ratio of the pump head to the rated head, $H_R$. In the present study, in order to have a better comparison between the model predictions and the experimental data, the normalised head is defined as the ratio of the two-phase pump head, $H_T$, to the single-phase head, $H_S$, at the same suction pressure.

The Results

The data for the various fluid mixture for both a three vane and four vane configuration are shown in the tables of FIGS. 10 and 12 respectively. This data is plotted and shown in FIGS. 11 and 13 as pressure/flow rate curves and compared against the pump pressure/flow rate performance with 100% water with the same injection setup parameters.

The air/water tests for the pump was reduced from pressure to meters of head so they could be compared with the pump tests running on water only.

The tests for air/water volumes was conducted at 30 psig.

Figure 11:
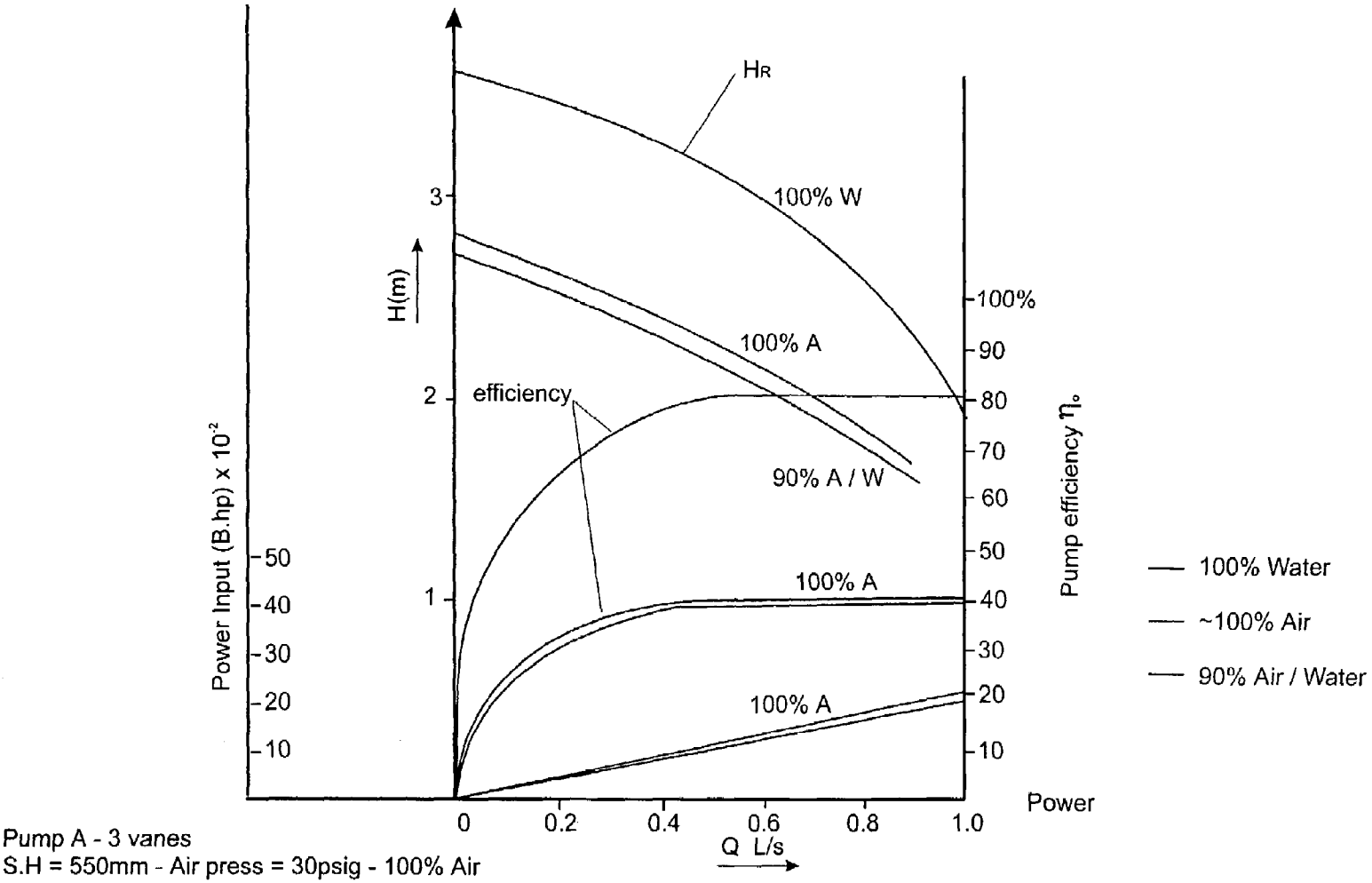
FIG. 11 shows a plot of head, power input, and pump efficiency verse flow rate Q, the tests being performed with a suction head of 550 mm, an air pressure of 30 psi (gauge), for a 3 vane impeller, the results of the 100% water, 100% air, and 90% air/water mix being plotted to illustrate the trends observed in the experiments.
Figure 13:
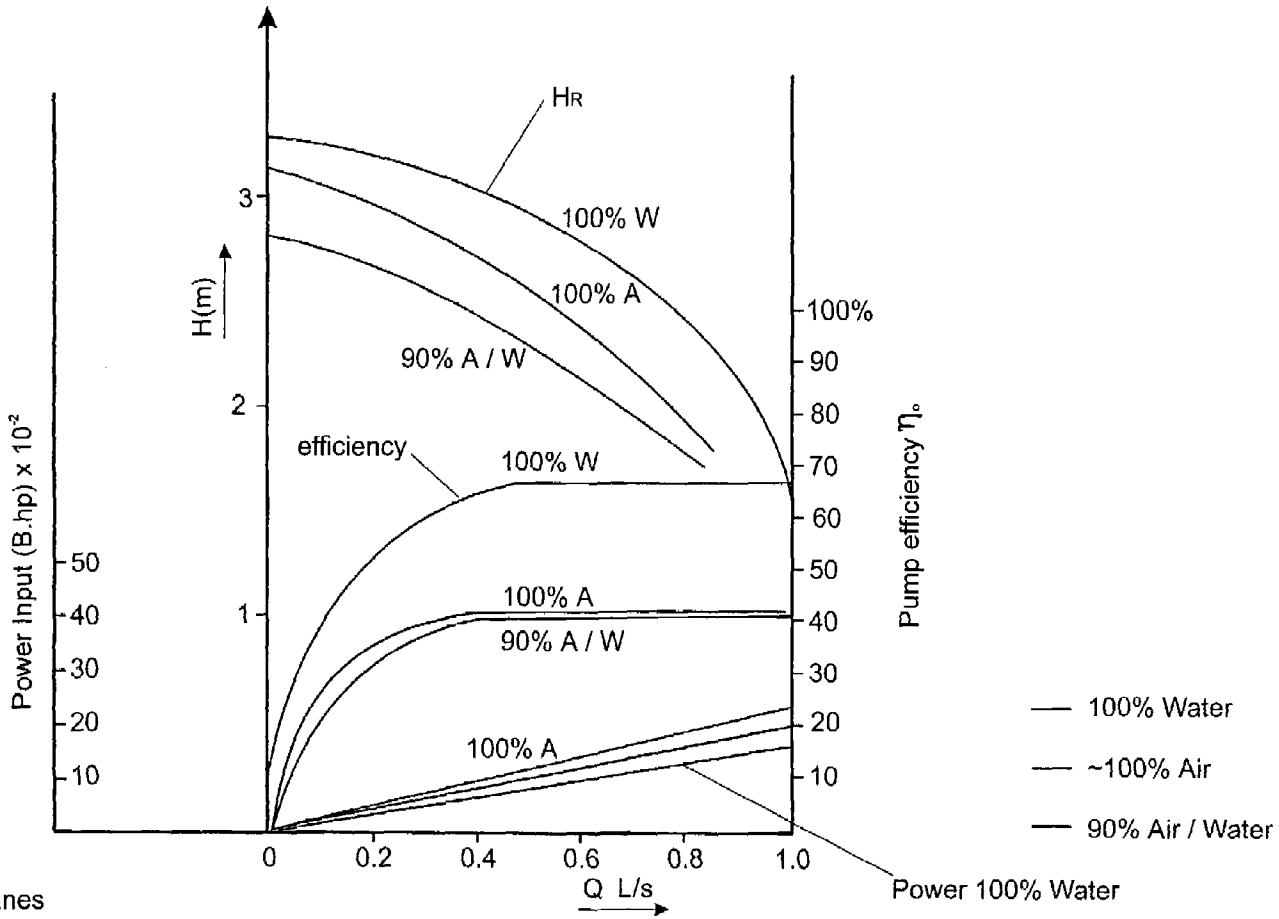
FIG. 13 shows a similar plot to FIG. 11 where head, power input, and pump efficiency have been plotted against flow rate Q, once again the results from the 100% water, 100% air, and the 90% air/water mix being plotted to emphasize the trends observed in the experiments.

FIGS. 11 and 13 show the characteristic curves for the pump at 90–100% air/water mixture.

The operation of the two pumps as set in these tests showed no surging for the range between 0–100% volume percent air. The operations were steady without head oscillations at any stage of the tested air volume. It was noticed that the pressure head values are higher with higher intake air pressures. Therefore, the air/water mixture through the pump can approach the performance of a centrifugal pump running on water.

Figures 14, 15:
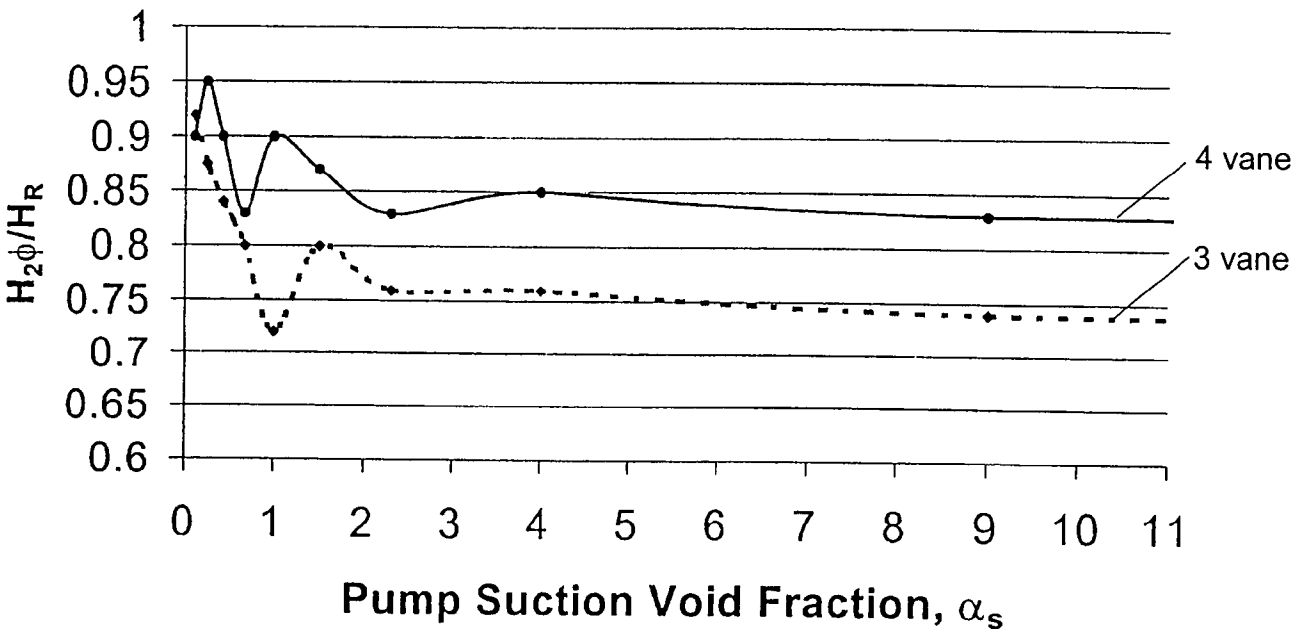
FIG. 14 is a table of data obtained from the experiments, the data relating to the pump suction void fraction $\alpha_s$ for both a three and four vane impeller, the values obtained being gathered for a variety of ratios or normalised pump head.
FIG. 15 is a plot of the data contained within the table of FIG. 14, for use of a four vane impeller clearly being superior to that of a three vane impeller.

FIG. 15 shows the normalised pump head ($H_{2\phi}/H_R$) with suction void fraction ($\alpha_s$). The test results showed no evidence of head degradation at any volume ratio of air/water mixture. Where no injection of bled fluid is provided it is expected that the loss in performance can be expected to occur well before the proportion of air is significant. Such drop in performance may occur at void fractions between 4 and 6.

When the local void increases, the gas velocity has to decrease and the liquid phase will then accelerate in order to maintain the total mass flow rate as a constant. The acceleration of the liquid phase within the pump impeller channels is the major mechanism responsible for the two-phase pump head degradation. It seems that the viscous forces would play a significant role in determining the final shape of these curves, as a larger value of dynamic viscosity is found in voids having more water volume than air, and the same value becomes less with increasing volume of air.

Although multi-phase products have been pumped for many years with two screw type pumps, centrifugal impeller pumps showed serious departure from published performance curves. The bands of calculated head, shown when surging begins, indicate the head oscillated from high to low values once the percent by volume of gas exceeds some point between seven percent and eleven percent by volume at intake. The test of the present invention have shown the ability of the modified centrifugal pump, with the upstream injection of bled fluid to increase the velocity head of intake fluid, to handle multi-phase products with high air void fractions.

The modification in centrifugal impeller by the reduction of the number of impeller blades and the use of an injection nozzle unit prior to entry to the pump showed a marked improvement over a large range of void fractions in the pumping ability of the centrifugal pump. With comparison between the results from the 4 vane and 3 vane charts, it can be seen that better results were obtained from the 4 bladed impeller.

| Nomenclature | |
|---|---|
| $d_B$: | Bleeding pipe diameter to nozzle |
| $d_N$: | Nozzle head diameter |
| g: | Gravity |
| $H_n$: | Nominal head |
| BHP: | Horse power |
| $H_{2\phi}$: | Two-phase pump head |
| $H_R$: | Rated head |
| L: | Taper length of nozzle |
| $n_s$: | Specific speed |
| P: | Pressure |
| $Q_n$: | Nominal flow rate |
| $\alpha$: | Void fraction |
| $\alpha_s$: | Suction void fraction |
| $\rho$: | Density |
| $\Delta\rho = \rho_L - \rho_g$: | Density difference |
| $\rho_g - \rho_L$: | Phase density |
| Z: | Number of blades |

The invention claimed is:

1. A pumping arrangement for pumping a pre-established multi-phase fluid flow, said arrangement comprising:

a centrifugal pump which has engaged thereto, a fluid inlet pipe connected in fluid communication with a multi-phase fluid source and an outlet pipe and said centrifugal pump being driveable by a power providing means, a fluid communication providing means to provide a communication of fluid between said outlet pipe and said inlet pipe, said fluid communication being such as to provide a fluid connection between said outlet pipe and said inlet pipe to deliver higher pressure multi-phase fluid from said outlet pipe into the lower pressure multi-phase fluid at said inlet pipe upstream of said centrifugal pump, when said centrifugal pump is in operation, wherein said centrifugal pump includes an impeller which has a plurality of vanes configured to define there between one of three and four impeller vane separated passageways.

2. The pumping arrangement as claimed in claim 1 wherein said arrangement is for pumping a fluid of gaseous/liquid mix.

3. The pumping arrangement as claimed in claim 1 wherein said power providing means is an electric motor.

4. The pumping arrangement as claimed in claim 1 wherein said fluid connection is a bleed line to bleed a portion of said fluid from the outlet pipe to the inlet pipe.

5. The pumping arrangement as claimed in claim 1 wherein said fluid connection between said outlet pipe and inlet pipe includes at least one nozzle at the inlet pipe for injection of bled fluid into the inlet pipe.

6. The pumping arrangement as claimed in claim 5 wherein said at least one nozzle provides, an increase in velocity head to said bled flow prior to the point of injection as a result of a reduction in the flow area of the at least one nozzle.

7. The pumping arrangement as claimed in claim 5 wherein said at least one nozzle is oriented in respect of the inlet pipe so as to impart a pre-pump rotational force onto an inlet side multiphase fluid.

8. The pumping arrangement as claimed in claim 7 wherein said pre-pump-rotation is in a direction co-rotatory with an impeller rotation direction.

9. The pumping arrangement as claimed in claim 1 wherein the impeller is one modified from an impeller of a centrifugal pump which would operate at or about peak efficiency but where the fluid is liquid only, said modification including the removal of vanes to provide said vane separated passageways.

10. A method of pumping pre-established multi-phase fluid flow, said method comprising:

providing a centrifugal pump which has engaged thereto a fluid inlet pipe connected in fluid communication with a multiphase fluid source and an outlet pipe through which said fluid is delivered, providing a power providing means to rotate the impeller of said centrifugal pump, and bleeding a portion of fluid from the outlet pipe and delivering the bled higher pressure multiphase fluid via a fluid connection providing means to said inlet pipe to be injected into the lower pressure main multiphase fluid flow into said centrifugal pump, wherein said centrifugal pump is provided with an impeller which has a plurality of vanes configured to define there between one of three and four impeller vane separated passageways.

11. The method of pumping as claimed in claim 10 wherein said method further includes providing a flow control means in said fluid connection providing means to allow the rate of bled fluid flow to be controlled.

12. The method of pumping as claimed in claim 10 wherein said method further includes the provision of a means to measure the volumetric rate and head of pressure of delivered fluid, the measurements taken to be utilised in setting of the flow control means.

13. The method of pumping as claimed in claim 10 wherein said bleeding includes prior to the injection of said fluid, splitting of fluid into at least two separated flow paths, wherein for each flow path there is an injection nozzle provided to inject the flow into a main suction flow to said centrifugal pump.

14. The method of pumping as claimed in claim 10 wherein said injection of said bled fluid induces a rotation onto the main multiphase fluid flow.

15. The method of pumping as claimed in claim 14 wherein said rotation is in a direction co-rotatory with a direction of rotation of the impeller.

16. A pumping arrangement in a ducted pre-established multi-phase fluid flow system, said arrangement comprising:

a centrifugal pump which has engaged thereto a fluid inlet pipe connected in fluid communication with a multiphase fluid source and an outlet pipe and driveable by a power providing means, a fluid communication providing means to provide a communication of fluid between said outlet pipe and said inlet pipe, said fluid communication means providing a fluid connection between said outlet pipe and said inlet pipe to deliver higher pressure multiphase fluid from said outlet pipe into the lower pressure multiphase fluid at to said inlet pipe when said centrifugal pump is in operation, wherein said centrifugal pump is provided with an impeller which has a plurality of vanes configured to define there between one of three and four impeller vane separated passageways.

* * * * *